US005183265A

United States Patent [19]

Umlauft et al.

[11] Patent Number: 5,183,265

[45] Date of Patent: Feb. 2, 1993

[54] RACQUETS, IN PARTICULAR TENNIS RACQUETS

[75] Inventors: Helmut Umlauft, Hard; Karl-Heinz Wäger, Götzis, both of Austria

[73] Assignee: Head Sportgerate Gesellschaft m.b.H. & Co. OHG, Kennelbach, Austria

[21] Appl. No.: 659,307

[22] PCT Filed: Sep. 11, 1990

[86] PCT No.: PCT/AT90/00091

§ 371 Date: May 16, 1991

§ 102(e) Date: May 16, 1991

[87] PCT Pub. No.: WO91/03283

PCT Pub. Date: Mar. 21, 1991

[30] Foreign Application Priority Data

Sep. 11, 1989 [AT] Austria ..... 2123/89

[51] Int. Cl.[5] ..... A63B 49/02

[52] U.S. Cl. ..... 273/73 C; 273/73 R; 273/73 G

[58] Field of Search ..... 273/73 R, 73 C, 73 G

[56] References Cited

U.S. PATENT DOCUMENTS

| | | | |
|---|---|---|---|
| 1,539,019 | 5/1925 | Nikonow . | |
| 4,280,699 | 7/1981 | Drake . | |
| 4,664,380 | 5/1987 | Kuebler . | |
| 4,725,059 | 2/1988 | DuGardin et al. . | |
| 4,768,786 | 9/1988 | Kuebler | 273/73 C |
| 4,911,444 | 3/1990 | Yoneyama | 273/73 C |
| 4,919,438 | 4/1990 | Yoneeyama . | |
| 4,997,186 | 3/1991 | Carr | 273/73 C |
| 5,037,098 | 8/1991 | Davis | 273/73 C |

FOREIGN PATENT DOCUMENTS

| | | | |
|---|---|---|---|
| 0171500 | 2/1986 | European Pat. Off. | 273/73 C |
| 340127 | 11/1989 | European Pat. Off. . | |
| 2751171 | 5/1979 | Fed. Rep. of Germany . | |
| 3826545 | 3/1989 | Fed. Rep. of Germany . | |
| 8402817 | 4/1986 | Netherlands | 273/73 C |

*Primary Examiner*—V. Millin
*Assistant Examiner*—Raleigh W. Chiu
*Attorney, Agent, or Firm*—Nixon & Vanderhye

[57] ABSTRACT

In a racquet, particularly a tennis racquet, having a handle (8) and a stretcher frame secured via a throat region (2) for stringing in which the cross-section of the stretcher frame measured transversely to the stringing has at least one section of largest dimension, the cross-section (a, b, c) of the stretcher frame in the throat region (2) and in the region of the racquet head (3) remote from the throat region is greater than in the region of the stretcher frame lying therebetween, whereby the cross-section (c) in the region of the racquet head (3) remote from the throat region is greater than the cross-section (b) in the throat region.

17 Claims, 3 Drawing Sheets

RACQUETS, IN PARTICULAR TENNIS RACQUETS

The present invention relates to a racquet, in particular a tennis racquet, having a handle and a stretcher frame secured via a throat region for stringing, in which the cross-section of the frame measured transversely to the stringing has at least one section of largest dimension.

A tennis racquet of the kind described at the beginning is shown, for example, in EP-A 176 021. In this known tennis racquet the width of the frame body increases, starting from the handle up to the mid-section of the stringing oval, and subsequently decreases again towards the racquet head. It is the purpose of this known design to adapt the resonant frequency of the strung racquet fixed to the handle approximately to the length of time the ball is in contact with the stringing.

When constructing a racquet it is important to keep undesired vibrations away from the handle and thus from the hand or arm of the player. If such undesired vibrations can be avoided, then it is subsequently possible to control the vibration in the handle area. At the same time, racquets are mostly constructed so that they are as light as possible and have a narrow construction transversely to the cross-sectional plane of the stringing, whereby however, the racquet is on the whole weaker and avoidance of vibrations is only inadequate.

The present invention aims to provide a racquet of the kind described at the beginning in which better control of vibrations in the handle area is possible even with a frame body that is light and narrow. To solve this object, the racquet according to the present invention is for the most part designed so that the cross-section of the stretcher frame in the throat region and in the region of the racquet head remote from the throat region is greater than in the region of the stretcher frame lying therebetween, whereby the cross-section in the region of the racquet head remote from the throat region is greater than that in the throat region. The weaker design of the frame, which can for the most part be attributed to the roundness of the frame in the head and throat regions, is compensated for by the fact that the cross-section of the stretcher frame in the throat region and in the region of the racquet head remote from the throat region handle is greater than in the region of the stretcher frame lying therebetween. The weaker sections are thus reinforced, which evens out the flexural properties over the length of the racquet from the handle to the head and subsequently results in easier controllability of vibrations. In addition to increasing the cross-section in the markedly rounded region at the racquet head and in the region of the throatpiece, these regions can, in accordance with a preferred embodiment of the present invention, also be made more resistant to bending by other measures. The only restriction to a more bending resistant design of these regions is the weight which increases with the use of more bending resistant inserts. Owing to the fact that the depth of the frame at the racquet head is greater than in the region of the throatpiece, dependence of the deflection of the racquet on the distance from the handle area is linearized while the vibrating mass in the region of the throatpiece is at the same time reduced. Whereas the dependence of the deflection on the distance from the handle is as a rule not constantly differentiable in conventional racquets and has a varying sign particularly at the transition points into the stringing oval, extensive linearization is already achieved if the first differentiation either has a constant sign over the length of the racquet or lies absolute in narrow limits.

It is an advantage of the embodiment that the change in the deflection over the length of the racquet amounts to less than 0.5 mm, in particular less than 0.3 mm, whereby under the test conditions according to HSTM standard 197-A the deflection is between 0.4 mm and 0.9 mm, preferably between 0.5 mm and 0.8 mm.

In accordance with the present invention, the racquet is advantageously designed in such a way that the cross-section of the frame body in the throat region is essentially constant. Such a design makes it possible to guarantee a high degree of reinforcement at the weaker points in the throat region with a relatively small increase in cross-section without requiring a large increase in mass in the throat region.

All told, optimum desired damping properties are achieved if the embodiment, in accordance with a preferred further development, is designed such that the stiffness of the individual regions from the handle to the racquet head is adjusted in such a way that under a predetermined load the deflection increases essentially linearly with the distance from a clamping point in the handle area.

The corresponding design with respect to the desired stiffness and the desired distribution of weight can be varied by choosing suitable materials. Compared with a conventional frame, a reduction in weight can even be achieved while simultaneously increasing the stiffness particularly by using fibre-reinforced, for example carbon fibre-reinforced hollow frames. The weight can be adjusted by varying the fibre portion in the material used for the frame or by using weight-increasing inserts. In a preferred embodiment of the racquet according to the present invention the percentage increase of the cross-section in the region of the racquet head and in the throat region is directly proportional to the percentage increase in the strung area of the racquet, whereby the percentage increase in the depth, as a function of the strung area of the racquet in the region of the racquet head remote from the throat region is greater than that in the throat region. Such a design surprisingly resulted in good linearization of the dependence of the deflection on the distance from the handle, whereby with the selection of a corresponding mass adjustment undesired vibrations are kept almost completely away from the handle area. In order not to affect the ball control and the playing properties in any way, the design advantageously provides that the sweet spot lies in the region of the frame that is of a narrower, essentially constant cross-section, whereby the spread of undesired vibrations up to the handle area can be prevented in a particularly simple manner in that the weight of the frame per unit of length in the region of the racquet head is greater than the weight of the frame per unit of length in the throat region.

Even better ball control can be achieved in that regions of maximum weight per unit of length in the region of the racquet head remote from the throat region and/or the transition of the throat region into the stringing oval are arranged outside the longitudinal axis of the racquet and symmetrically thereto, whereby the eccentric arrangement of agglomerations of mass permits particularly powerful play.

The desired linearization of the dependence of the deflection on the distance from the handle must, as a function of the respective strung area, result in different increases in cross-section, whereby the embodiment is advantageously designed in such a way that for strung areas between 600 and 720 $cm^2$ the depth in the throat region is 16 to 24%, preferably about 20% greater, and the depth in the region of the racquet head remote from the throat region is 20 to 44%, preferably about 30% greater than the depth of the frame in the region of the stretcher frame lying between the region of the racquet head remote from the throat region and the throat region. To be able to substantially reduce the vibrating masses in the throat region while at the same time having a high degree of stiffness in this region, the embodiment advantageously provides that the weight of the frame per unit of length in the throat region is less than or equal to the weight of the frame per unit of length between the throat region and the region of the racquet head remote from the throat.

The present invention is explained in greater detail herebelow on the basis of the exemplary embodiments illustrated in the drawings.

Figure 3:
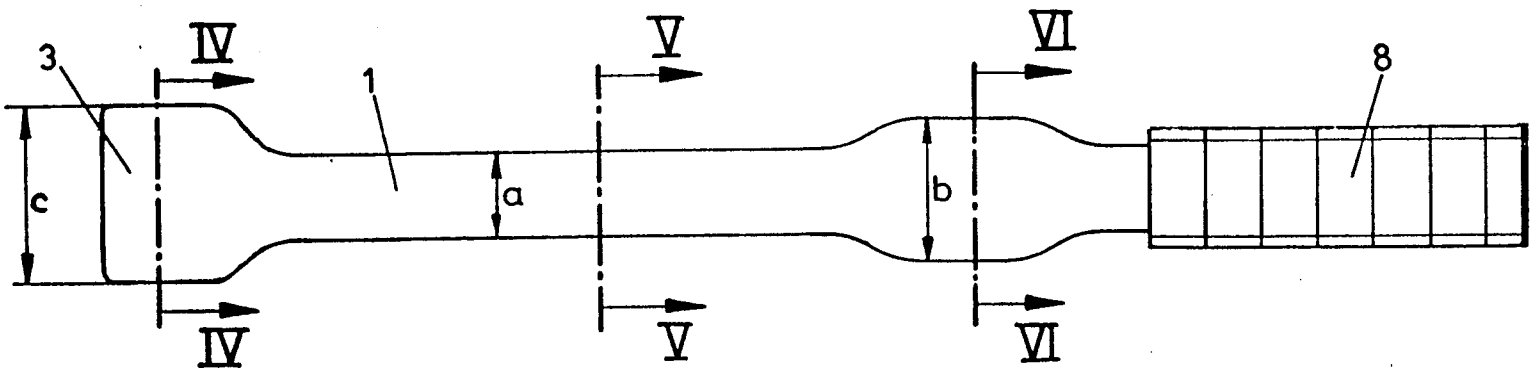
FIG. 3 shows a side view of a racquet according to the present invention.
Figure 6:
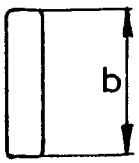
Figure 5:
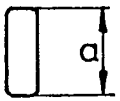
Figure 4:
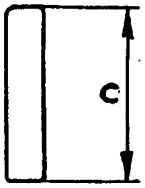
Figure 7:
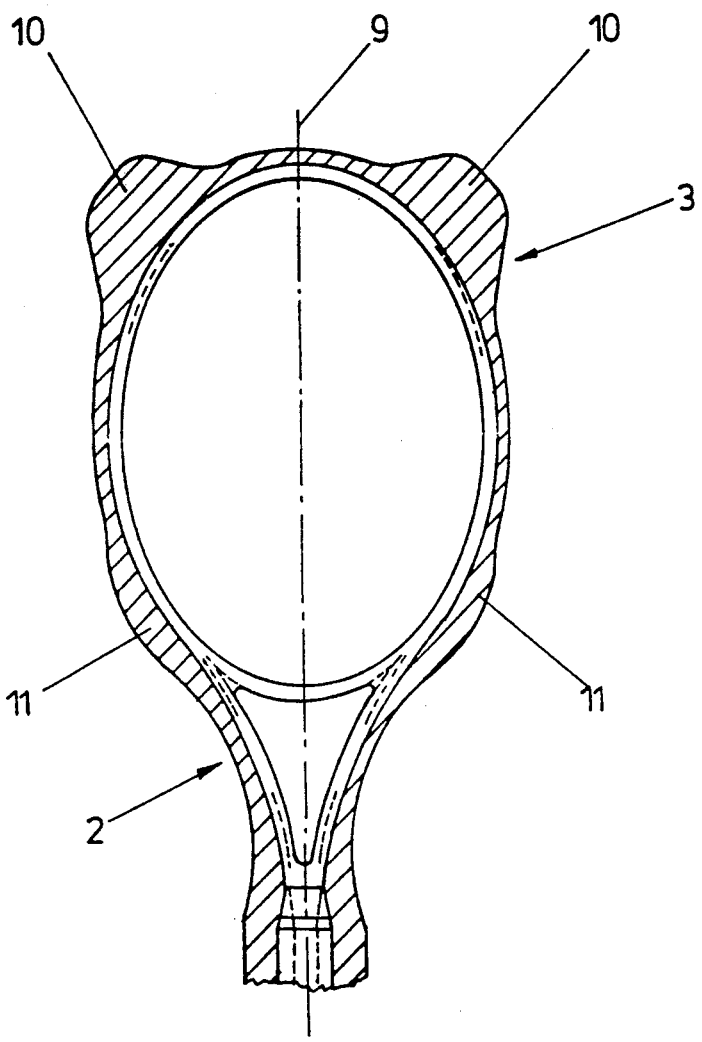

FIGS. 4, 5 and 6 respectively show sections along lines IV—IV, V—V and VI—VI of FIG. 3, and FIG. 7 schematically illustrates the distribution of mass of a racquet according to the present invention.

Figure 1:
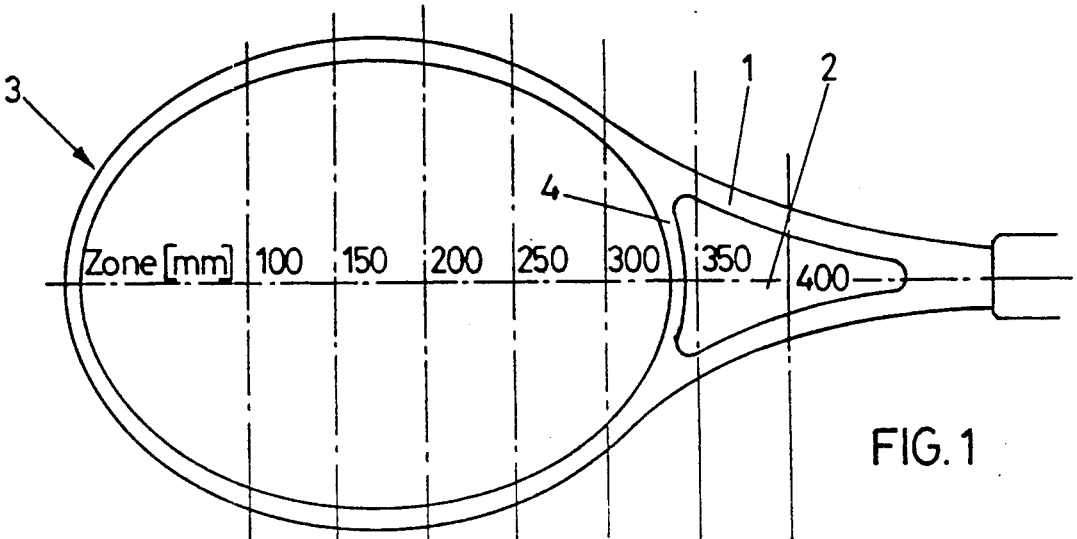
FIG. 1 shows a view of a tennis racquet frame.

The racquet according to FIG. 1 is formed from a frame body 1 which, to begin with, defines a throatpiece 2 and which is more sharply curved in the region of the racquet head 3 facing away from the handle. The portion 4 of the frame defining the stringing oval is also more sharply curved in the region of the throatpiece 2. In the illustration according to FIG. 1, zones are marked in millimeters, these zones corresponding to deflection values plotted therebelow in FIG. 2. The flexural tests were hereby carried out in accordance with the HSTM standard 197-A such that a rigid support for the racquet frame was respectively formed at a distance of 50 mm to the left and right of the measured zone and the respective deflection value was measured by loading the corresponding zone with a predetermined force of 1000N.

In the bending flex test according to HSTM standard 197-A, the bending behaviour of racquets, which have been divided into seven zones, is measured by using a lower support bearing consisting of two support bearing members in the form of bars of 38 mm diameter spaced 150 mm apart and an upper support bearing member formed as a bar of similar diameter. The test machine is set for pressure testing.

Figure 2:
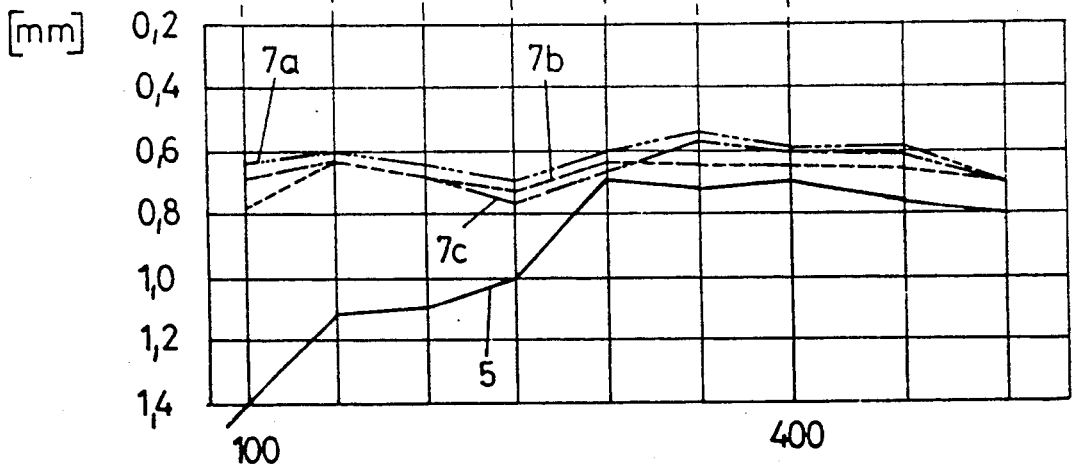
FIG. 2 shows deflection characteristic curves measured with such racquets.

In FIG. 2, curve 5 corresponds to a conventional racquet without the modifications according to the present invention, whereby deflection varying over the axial length of the racquet is clearly observed in the individual zones. Particularly pronounced hereby is the relative constancy of the measured values between zones 150 and 250 and the clearly rapid decrease in rigidity in the region of the racquet head. Curve 5 for deflections in conventional racquets has areas with a dimension that changes sharply in broad absolute ranges of the deflection. In comparison, the dot-dash curves *7a*, *7b*, *7c* are measured on the basis of measured values for racquets according to the invention that are of different sizes and clearly show that the flexural properties extend almost uniformly over the axial length in a narrow range of 0.25 mm. These flexural properties result from a construction as illustrated in FIG. 3. Curve *7a* is measured for racquets with an area of 720 $cm^2$, curve *7b* for 660 $cm^2$ and *7c* for 600 $cm^2$.

FIG. 3 illustrates the frame body 1 of a racquet from the side, its cross-section c in the region of the racquet head 3 being about 30% greater than the depth a in the adjacent region. Depth b, which is normally in the stringing plane of the frame 1, is likewise greater in the region of the throatpiece 2. The handle of the racquet is identified by reference numeral 8.

The respective cross-sectional shapes of the frame are illustrated in greater detail in FIGS. 4, 5 and 6, whereby as a function of the strung area the depths according to the following table are used to achieve a substantially linear or uniform deflection behaviour in a narrow range:

| Playing surface ($cm^2$) | c (mm) | a (mm) | b (mm) |
|---|---|---|---|
| 720 | 36 | 25 | 31 |
| 660 | 33 | 25 | 30 |
| 600 | 30 | 25 | 29 |

The cross-section b in the throat region thereby generally lies above the handle thickness measured in the same direction.

FIG. 7 schematically illustrates the mass distribution of a racquet, whereby the extent of the cross-hatched area in each case illustates a measure for the mass in the respective region of the racquet. Areas 10 with a larger mass per unit of length are thereby provided in the region of the racquet head symmetrically to the longitudinal axis 9, which areas can be achieved by means of a corresponding multi-layered design of the frame and/or the arrangement of additional weights in the area of enlarged cross-section. Areas 11 with a larger mass per unit of length are likewise provided at the transition from the throat region 2 into the stringing oval in order to achieve the desired vibrating and deflection behaviour. Generally the weight per unit of length in the head region 3 is greater than that in the throat region 2 and maximum stiffness should be achieved with the greater depth c in the head region and a high degree of stiffness with a reduction in weight should be achieved with the larger cross-section b in the throat region 2. The weakened rounded areas are purposefully strengthened by the reinforcements in the head and throat regions and thus the substantially linear and above all uniform shape of the deflection, as illustrated in FIG. 2, in a narrow range between 0.5 mm and 0.8 mm as a function of the distance from the handle is obtained.

We claim:

1. A tennis racquet, comprising:

a handle;

a stretcher frame secured via a throat region to the handle for stringing a racquet head in which the cross-sectional area of the stretcher frame measured transversely to the stringing plane as at least one section of largest dimension, such that the cross-sectional area of the stretcher frame in the throat region and in the region of the racquet head remote from the throat region is greater than in the region of the stretcher frame lying therebetween; and wherein the cross-sectional area in the region of the racquet head remote from the throat region is greater than the cross-sectional area in the throat region; and wherein the cross-sectional area of the frame in the throat region is essentially constant.

2. A racquet according to claim 1, wherein the racquet is designed to be more resistant to bending in the regions having an enlarged cross-sectional area.

3. A racquet according to claim 1 wherein the stiffness of the individual regions from the handle to the racquet head is adjusted in such a way that under predetermined loading the deflection increases directly proportional with the distance from a clamping point in the handle.

4. A racquet according to claim 1, wherein the change in deflection over the length of the racquet amounts to less than 0.5 mm, whereby under the test conditions according to HSTM standard 197-A deflection is between 0.4 mm and 0.9 mm.

5. A racquet according to one of claim 1, wherein the sweet spot lies in the region of the frame that is of a narrower, essentially constant cross-sectional area.

6. A racquet according to claim 1, wherein the weight of the frame per unit of length in the region of the racquet head is greater than the weight of the frame per unit of length in the throat region.

7. A racquet according to claim 1, wherein regions of maximum weight per unit of length in the region of the racquet head remote from the throat region at the transition of the throat region into the stringing oval are arranged outside the longitudinal axis of the racquet and symmetrically thereto.

8. A racquet according to claim 1, wherein the racquet has a strung area ranging between 600 and 700 $cm^2$, the depth in the throat region is 16 to 24% greater, and the depth in the region of the racquet head remote from the throat region is 20 to 44%, greater than the depth of the frame in the region of the stretcher frame lying between the region of the racquet head remote from the throat region and the throat region.

9. A racquet according to claim 1, the weight of the frame (1) wherein per unit of length in the throat region is less than or equal to the weight of the frame per unit of length between the throat region and the region of the racquet head facing away from the throat region.

10. A tennis racquet, comprising:

a handle;

a stretcher frame secured via a throat region to the handle for stringing a racquet head in which the cross-sectional area of the stretcher frame measured transversely to the stringing plane has at least one section of largest dimension, such that the cross-sectional area of the stretcher frame in the throat region and in the region of the racquet head remote from the throat region is greater than in the region of the stretcher frame lying therebetween; and wherein the cross-sectional area in the region of the racquet head remote from the throat region is greater than the cross-sectional area in the throat region; and wherein the percentage increase of the cross-sectional area in the region of the racquet head remote from the throat region and in the throat region is directly proportional to the percentage increase in the strung area of the racquet, whereby the percentage increase in the depth, as a function of the strung area of the racquet, in the region of the racquet head remote from the throat region is greater than the percentage increase in depth in the throat region.

11. A racquet according to claim 10, wherein the percentage increase of the cross-sectional area in the region of the racquet head remote from the throat region and in the throat region is directly proportional to the percentage increase in the strung area of the racquet, whereby the percentage increase in the depth, as a function of the strung area of the racquet, in the region of the racquet head facing away from the throat region is greater than the percentage increase in the depth in the throat region.

12. A racquet according to claim 10, wherein the change in deflection over the length of the racquet amounts to less than 0.5 mm, whereby under the test conditions according to HSTM standard 197-A deflection is between 0.4 mm and 0.9 mm.

13. A tennis racquet comprising:

a handle;

a racquet head secured via a throat to the handle, and having a strung area; the racquet head having a region remote from the throat region with a first cross-sectional area and a throat region with a second cross-sectional area, said first and second cross-sectional areas measured transversely to a plane containing the strung area; and wherein the percentage increase of the cross-sectional area in the region of the racquet head remote from the throat region and in the throat region is directly proportional to the percentage increase in the strung area of the racquet, whereby the percentage increase in the depth, as a function of the strong area of the racquet, in the region of the racquet head remote from the throat region is greater than the percentage increase in the depth in the throat region.

14. A racquet according to claim 13, wherein the weight of the frame per unit of length in the racquet head is greater than the weight of the frame per unit of length in the throat region.

15. A racquet according to claim 14, wherein the regions of maximum weight per unit of length in the region of the racquet head remote from the throat region at the transition of the throat region into the stringing oval are arranged outside the longitudinal axis of the racquet and symmetrically thereto.

16. A racquet according to claim 15, wherein the racquet has a strung area ranging between 600 and 720 $cm^2$, the depth in the throat region is 16 to 24% greater, and the depth in the region of the racquet head remote from the throat region is 20 to 44% greater than the depth of the frame in the region of the stretcher frame lying between the region of the racquet head remote from the throat region and the throat region.

17. A racquet according to claim 16, wherein the weight of the frame per unit of length in the throat region is less than or equal to the weight of the frame per unit of length between the throat region and the region of the racquet head facing away from the handle.

* * * * *